US009738442B2

(12) United States Patent
Pedersen

(10) Patent No.: US 9,738,442 B2
(45) Date of Patent: Aug. 22, 2017

(54) METHODS AND SYSTEMS FOR WASTE MANAGEMENT

(71) Applicant: The Boeing Company, Huntington Beach, CA (US)

(72) Inventor: Aaron John Pedersen, North Charleston, SC (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 14/718,787

(22) Filed: May 21, 2015

(65) Prior Publication Data

US 2016/0340117 A1 Nov. 24, 2016

(51) Int. Cl.
*B65F 1/00* (2006.01)
*B65F 1/16* (2006.01)

(52) U.S. Cl.
CPC ..... *B65F 1/0093* (2013.01); *B65F 1/1607* (2013.01); *B65F 1/1623* (2013.01); *B65F 1/1638* (2013.01); *B65F 1/1646* (2013.01); *B65F 2210/1125* (2013.01)

(58) Field of Classification Search
CPC ..... B65F 1/0093; B65F 1/1607
USPC ..... 318/3, 400.01, 700
See application file for complete search history.

(56) References Cited

U.S. PATENT DOCUMENTS 203,817 A 5/1878 Brock
4,032,037 A 6/1977 Dubery et al.
4,108,498 A 8/1978 Bentsen
4,993,882 A * 2/1991 Nishizuka ..... E04F 17/10 406/117
5,083,704 A 1/1992 Rounthwaite
5,221,010 A 6/1993 Bianco
5,253,766 A 10/1993 Sims
5,316,152 A 5/1994 Ross
5,492,227 A 2/1996 Millette et al.
5,667,136 A 9/1997 Chen
5,695,115 A * 12/1997 Shantzis ..... B65F 1/0093 209/706
5,772,112 A 6/1998 Bulcroft
5,806,759 A 9/1998 Axisa
6,024,238 A 2/2000 Jaros
6,810,819 B2 11/2004 Kaniuk et al.
7,070,064 B1 7/2006 Henry et al.
(Continued)

FOREIGN PATENT DOCUMENTS

WO 9320006 A1 10/1993
WO 2006123123 A1 11/2006
(Continued)

*Primary Examiner* — Kawing Chan
(74) *Attorney, Agent, or Firm* — Armstrong Teasdale LLP

(57) ABSTRACT

A waste containment system for use with a waste management system, having a chute and a container, includes a sensor configured to determine a position of a chute top lid. The waste containment system also includes at least one pivoting mechanism operatively coupled to at least one flap of a container top lid. The pivoting mechanism is configured to move the at least one flap between an open position and a closed position. The waste containment system also includes a controller operatively coupled to the sensor and to the at least one pivoting mechanism. The controller is configured to control the pivoting mechanism based on the determined position of the chute top lid.

20 Claims, 7 Drawing Sheets

(56) References Cited

U.S. PATENT DOCUMENTS

| | | | | |
|---|---|---|---|---|
| 7,690,493 | B1 | 4/2010 | Nunis | |
| 7,958,704 | B2 * | 6/2011 | Stravitz | B65B 9/15 206/303 |
| 8,523,051 | B2 | 9/2013 | Clancy et al. | |
| 8,771,606 | B2 * | 7/2014 | Sun | 206/362.1 |
| 2003/0136279 | A1 | 7/2003 | Tarlow | |
| 2009/0126473 | A1 | 5/2009 | Porat et al. | |
| 2009/0314665 | A1 | 12/2009 | Konstantinos | |
| 2012/0321395 | A1 | 12/2012 | Alfrost et al. | |

FOREIGN PATENT DOCUMENTS

| | | | |
|---|---|---|---|
| WO | 2013072655 | A1 | 5/2013 |
| WO | 2014029903 | A1 | 2/2014 |
| WO | 2014114849 | A1 | 7/2014 |
| WO | 2015015053 | A1 | 2/2015 |
| WO | 2015015054 | A1 | 2/2015 |
| WO | 2015015055 | A1 | 2/2015 |

* cited by examiner

METHODS AND SYSTEMS FOR WASTE MANAGEMENT

BACKGROUND

The field of the disclosure relates generally to waste management systems, and more specifically, to transferring waste from an elevated platform to ground level.

At least some known manufacturing facilities include elevated platforms that provide technicians access to a specified work site on a product, such as an aircraft. As the technicians perform their duties, an amount of waste is generated that requires sorting into various categories. For example, when working on an aircraft, waste is generally sorted into three different types: flammable waste, corrosive waste, and general foreign object debris (FOD) waste. At least some known facilities store a separate waste container for each waste type on the platform. Each waste container also includes a lid to contain not only the waste, but also any potentially harmful vapors from escaping the waste container.

A waste collection team is responsible for emptying the waste containers, often multiple times per day, on each platform. At least some known manufacturing facilities require the waste collection team to ascend a set of platform stairs to retrieve a waste container and descend the stairs, while carrying the heavy waste container, to empty the waste container at ground level. The waste collection team then ascends the stairs to replace the first waste container and retrieve a second waste container. As a result, members of the waste collection team may ascend and descend stairs between 75-100 times per day. Furthermore, the waste collection team is often carrying a waste container each time they ascend and descend the stairs, which may lead to a loss of balance or other safety concerns.

One known solution is to provide a chute at the platform that deposits waste into an associated container. The waste travels down the chute from the platform and impinges a pair of hinged flaps that open upon impact to allow the waste to fall into the container. The hinged flaps include a spring mechanism that returns the flaps to a position that covers an opening in the chute to reduce an amount of waste vapor from traveling up the chute. The mechanical springs may have decreased performance over time, causing the spring to be replaced periodically to maintain the performance desired to prevent vapors from escaping back up the chute.

Additionally, storing the waste containers on the platform itself limits the space available to the technicians to move around on the platform and perform their duties and also represents a possible trip hazard for the technicians.

BRIEF DESCRIPTION

In one aspect, a waste containment system for use with a waste management system having a chute and a container is provided. The waste containment system includes a sensor configured to determine a position of a chute top lid and at least one pivoting mechanism operatively coupled to at least one flap of a container top lid. The pivoting mechanism is configured to move the at least one flap between an open position and a closed position. The waste containment system also includes a controller operatively coupled to the sensor and to the at least one pivoting mechanism. The controller is configured to control the pivoting mechanism based on the determined position of the chute top lid.

In another aspect, a waste management system is provided. The waste management system includes a chute comprising a bottom end, a top end, and a chute lid coupled at the top end. The waste management system also includes a container having a container lid coupled to the bottom end. The container lid includes an opening defined therein and at least one flap configured to selectively cover at least a portion of the opening. The waste management system further includes a waste containment system including a sensor configured to determine a position of the chute lid and at least one pivoting mechanism operatively coupled to the at least one flap. The pivoting mechanism is configured to move the at least one flap between an open position and a closed position. The waste containment system further includes a controller operatively coupled to the sensor and to the at least one pivoting mechanism. The controller is configured to control the pivoting mechanism based on the determined position of the chute lid.

In yet another aspect, a method of assembling a waste containment system for use with a waste management system, having a chute and a container, is provided. The method includes coupling a sensor to a chute top end proximate a chute top lid. The sensor is configured to determine a position of the chute top lid. The method also includes coupling at least one pivoting mechanism to a flap of a container top lid. The pivoting mechanism is configured to move the flap between an open position and a closed position. The method further includes coupling a controller to the container top lid. The controller is operatively coupled to the sensor and to the at least one pivoting mechanism such that the controller moves the pivoting mechanism based on the determined position of the chute top lid.

The features, functions, and advantages that have been discussed can be achieved independently in various embodiments or may be combined in yet other embodiments, further details of which can be seen with reference to the following description and drawings.

DETAILED DESCRIPTION

The embodiments described herein facilitate depositing various types of waste into a respective chute on a platform and collecting the waste in containers located at ground level. A technician determines whether they have FOD (foreign object debris) waste, corrosive waste, or flammable waste and deposits the waste into an appropriate chute at a waste disposal station located on the platform. An electronic vapor lock system detects that a chute lid has been opened on the platform and activates an actuator on the container lid to pivot a flap to allow the waste to fall into the container. When the technician closes the chute lid, the electronic vapor lock system again activates the actuator, after a predetermined time delay, to close the container lid and contain any waste vapors or particulate within the container.

Figure 1:
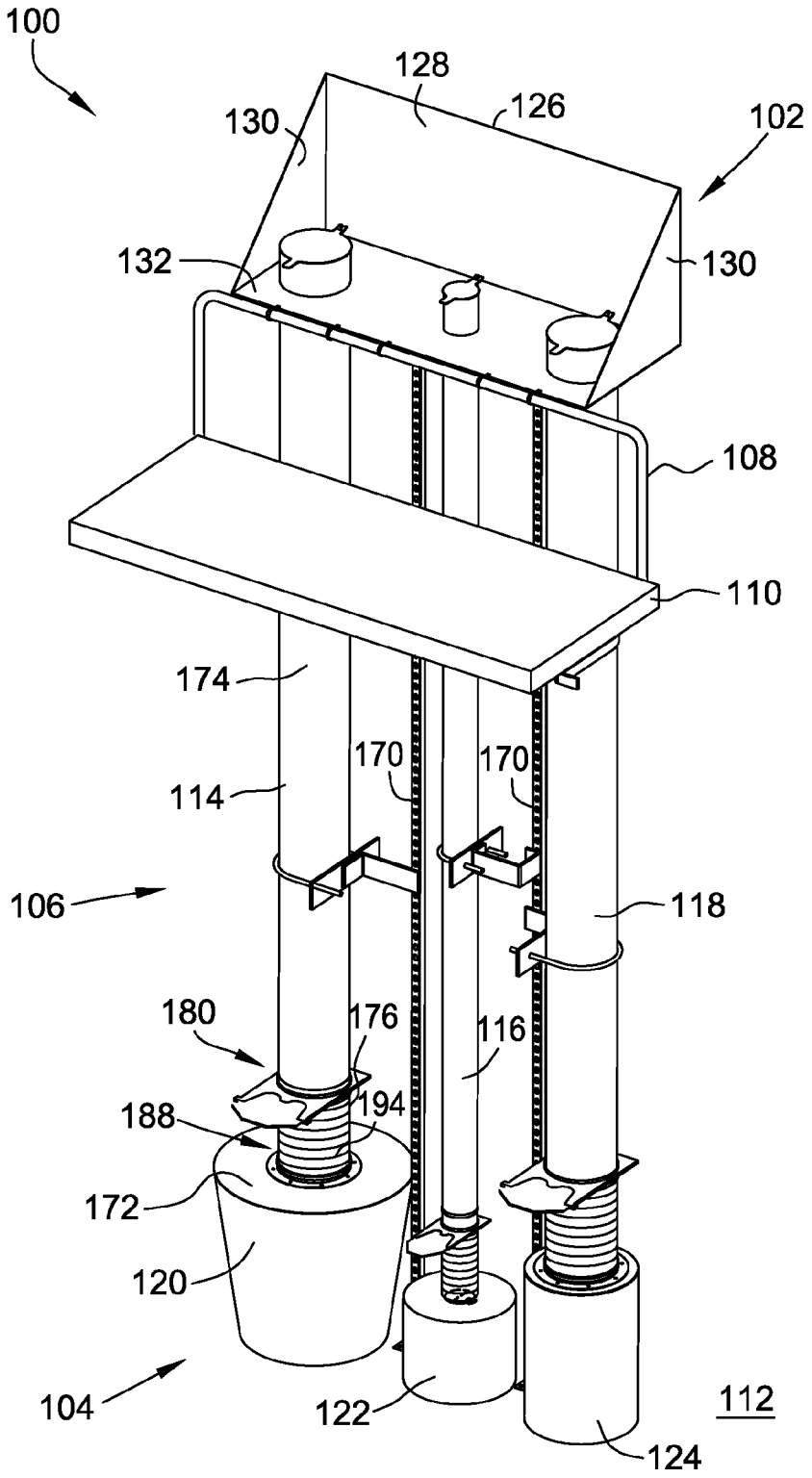
FIG. 1 is a perspective view of an exemplary waste management system including a plurality of chutes and containers.

FIG. 1 is a perspective view of an exemplary waste management system 100. In the exemplary implementation, system 100 includes a waste disposal station 102, a plurality of waste containers 104, and a plurality of chutes 106 coupled between station 102 and a respective container 104. System 100 is used to transfer waste from waste disposal station 102 and through plurality of chutes 106 for disposal in plurality of containers 104. In the exemplary implementation, waste disposal station 102 is coupled to a railing 108 of an elevated platform 110, and containers are located at ground level 112 such that the waste generated by technicians working on platform 110 is channeled through chutes 106 to ground level 112.

In the exemplary implementation, plurality of chutes 106 includes a first chute 114, a second chute 116, and a third chute 118. Similarly, plurality of containers 104 includes a first container 120 coupled to first chute 114, a second container 122 coupled to second chute 116, and a third container 124 coupled to third chute 118. First chute 114 channels general foreign object debris (FOD) waste between waste disposal station 102 at platform 110 and first container 120, while second chute 116 channels flammable waste, and third chute 118 channels corrosive waste. According to federal Occupational Safety and Health Administration (OSHA) regulations, different types of waste must be separated and clearly identified by color. More specifically, second container 122 is colored red to indicate flammable materials contained therein, while third container 124 is colored yellow to indicate corrosive materials contained therein. Although waste management system 100 illustrates three separate chutes and containers in FIG. 1, in other implementations, waste management system 100 may include only a single chute and associated container. Generally, waste management system 100 may include any number of chutes and associated containers as desired.

Figure 2:
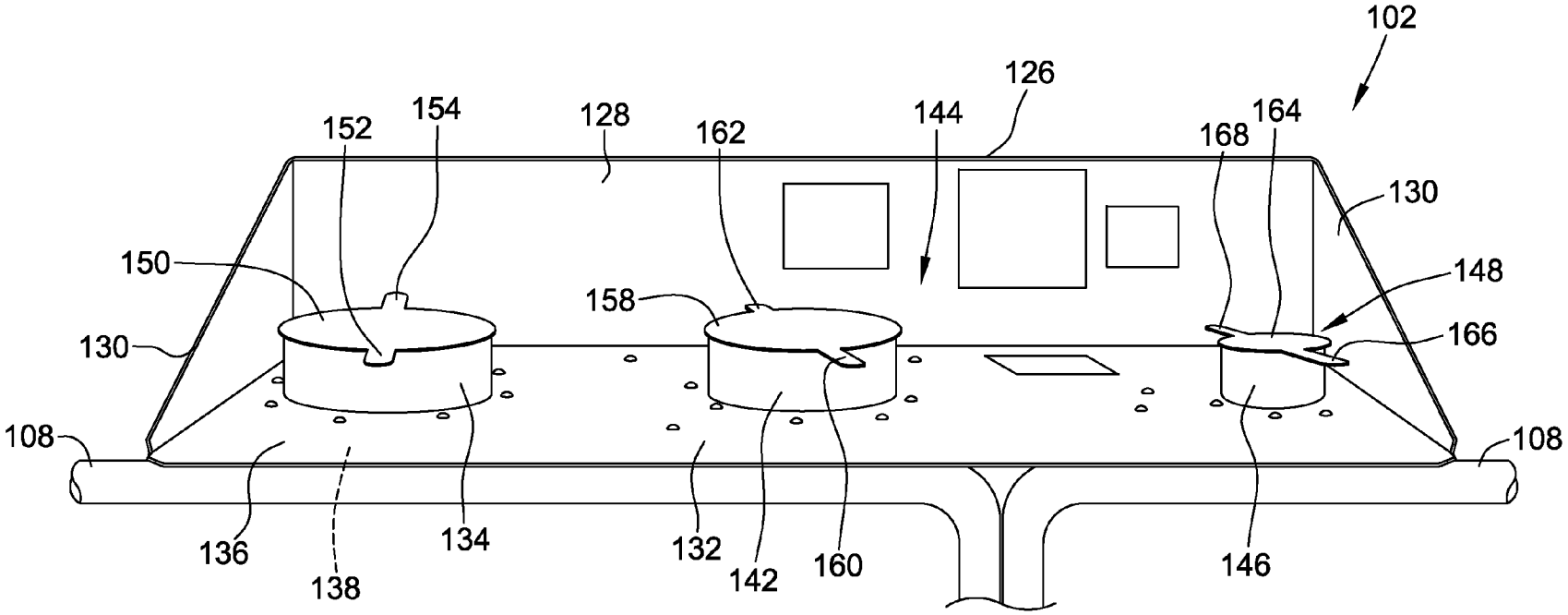
FIG. 2 is a perspective view of an exemplary waste disposal station that may be used with the waste management system shown in FIG. 1.

FIG. 2 is a perspective view of waste disposal station 102 that may be used with waste management system 100 (shown in FIG. 1). In the exemplary implementation, waste disposal station 102 is coupled to railing 108 such that station 102 overhangs railing 108. As such, a technician working on platform 110 (shown in FIG. 1) is able to utilize substantially an entire area of platform 110 without any portion of waste management system 100 interfering. Waste disposal station 102 includes a housing 126 that includes a rear wall 128, a pair of sidewalls 130, and a bottom wall 132. Walls 128, 130, and 132 of housing 126 are configured to reduce a risk of waste falling from platform 110 to ground level 112 below. In the exemplary implementation, housing 126 is formed from a lightweight, non-corrosive material, such as, but not limited to, aluminum. Alternatively, housing 126 is formed from any material that enables operation of waste disposal station 102 as described herein.

In one implementation, first chute 114 includes a top end 134 that extends upwards through bottom wall 132 of housing 126. As such, both a top surface 136 and a bottom surface 138 of bottom wall 132 are coupled to top end 134 to provide structural integrity to first chute 114. Furthermore, top end 134 also defines an opening 140 into which the technicians may deposit the waste. Similarly, second chute 116 includes a top end 142 that extends through bottom wall 132 and defines an opening 144 and third chute 118 includes a top end 146 that extends through bottom wall 132 and defines an opening 148. Alternatively, chutes 114, 116, and 118 are coupled to housing 126 in any manner that enable operation of waste disposal station 102 as described herein.

Figure 3:
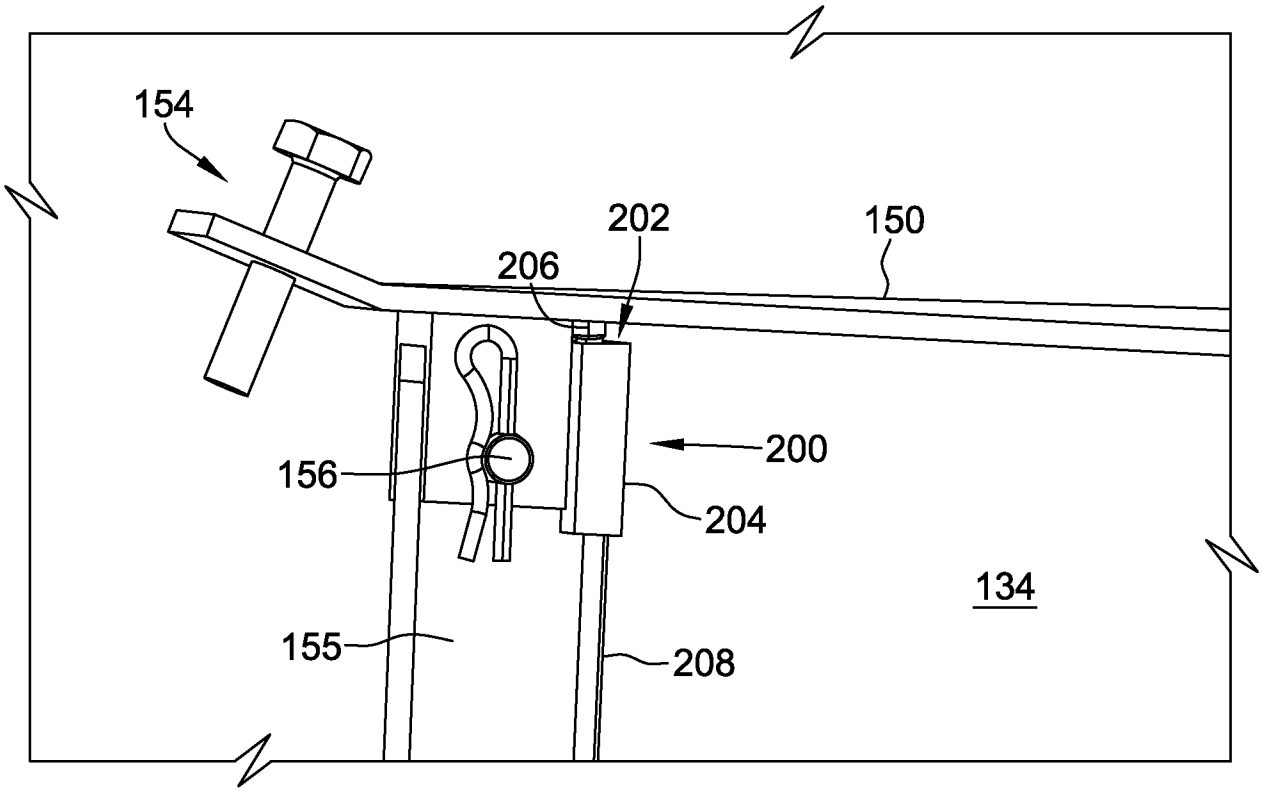
FIG. 3 is a side view of an exemplary chute lid, of the waste disposal station shown in FIG. 2, in a first position.
Figure 4:
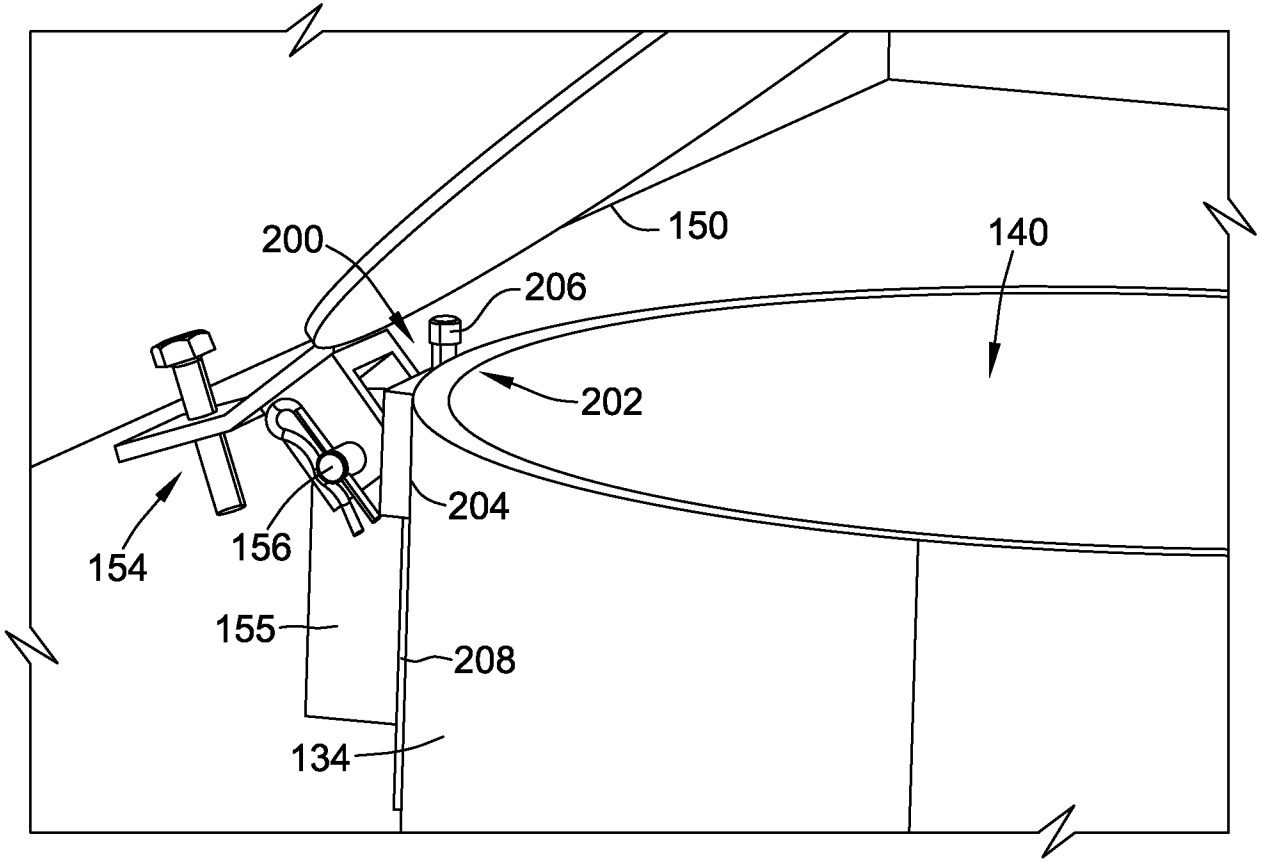
FIG. 4 is a side view of the chute lid in a second position.

FIG. 3 is a side view of a lid 150 of first chute 114 in a closed position, and FIG. 4 is a side view of first chute lid 150 in an open position. Lid 150 includes a handle 152 (shown in FIG. 2) and a stopper mechanism 154 (shown in FIG. 2). Handle 152 is engaged manually by a technician to lift lid 150 from opening to allow the technician to deposit waste into first chute 114. As the technician lifts handle 152, lid 150 pivots about a pivot point 156 until stopper mechanism 154 contacts top end 134. Alternatively, stopper mechanism 154 contacts a spacer block 155 coupled to top end 134. In the exemplary implementation, stopper mechanism 154 contacts top end 134 before lid 150 has pivoted 90 degrees. As such, stopper mechanism 154 prevents lid 150 from being opened past a predetermined point such that lid 150 cannot remain in the opened second position when not being manually held open by a technician. Alternatively, stopper mechanism 154 may extend from the outer surface of top end 134 and contact lid 150 when the technician lifts lid 150 to a predetermined position. In operation, lid 150 covers opening 140 and prevents any vapors or airborne particles from rising through first chute 114 and escaping through opening 140 at top end 134.

Similarly, second chute 116 includes a lid 158 that includes a handle 160 and a stopper 162, and third chute 118 includes a lid 164 that includes a handle 166 and a stopper 168. In the exemplary implementation, lids 150, 158, and 164 are each colored a different color to indicate which type of waste is meant to be deposited therein. For example, lid 150 on first chute 114 is colored grey to indicate general FOD waster, lid 158 on second chute 116 is colored red to indicated flammable waste, and lid 164 on third chute 118 is colored yellow to indicate corrosive waste. As such, lids 150, 158 and 164 are colored in accordance with OSHA regulations to indicate a specific type of waste to be deposited therein.

In the exemplary implementation, waste management system 100 also includes an electronic vapor lock system 200 that facilitates preventing vapors and other waste particulates from escaping any of containers 120, 122, and 124 and traveling up associated chutes 114, 116, and 118. Vapor lock system 200 includes a first sensor 202 coupled to top end 134 of first chute 114. Sensor 202 includes a housing 204 coupled to top end 134 and a sensor pin 206 extending upward from housing 204. When lid 150 is in the closed position, as shown in FIG. 3, lid 150 biases pin 206 downward in a first position. When lid 150 is in the open position, as shown in FIG. 4, lid 150 no longer biases pin 206 to a second position where pin 206 extends further from housing 204 than in the first position. In the exemplary implementation, vapor lock system 200 also includes a signal line 208 that extends from housing 204 downward along first chute 114. When pin 206 is in the second position, pin 206 completes a circuit within housing that causes an electronic signal to be transmitted through signal line 208, as described in further detail below. Alternatively, sensor 202 is an optical sensor that determines a position of lid 150.

Similarly, although not shown, second chute 116 and third chute 118 each include a sensor having a housing, pin, and signal wire. Alternatively, vapor lock system 200 is a wireless system that includes a wireless transmitter to transmit a signal rather than signal line 208. In the exemplary implementation, manual opening of lid 150 by the technician is preferred. Alternatively, vapor lock system 200 may include another sensor (not shown) proximate lid 150 that senses a technician in proximity to chute 114 and causes lid 150 to automatically open.

Referring again to FIG. 1, waste management system 100 includes at least one support beam 170 that supports the weight of waste disposal station 102. In the exemplary implementation, supports beams 170 are substantially parallel to each chute 106 and extend between bottom wall 132 of housing 126 and ground level 112. In another suitable implementation, such as when platform 110 and railing 108 are moveable, support beams 170 extend between bottom wall 132 and at least one of railing 108 and platform 110 to allow for mobility of platform 110.

Except as specifically described otherwise, chutes 114, 116, and 118 of plurality of chutes 106 are substantially similar to each other. As such, only first chute 114 is described herein in detail. However, second and third chutes 116 and 118 include similar features and components. First chute 114 extends between waste disposal station housing 126 and a lid 172 of first container 120. In the exemplary implementation, first chute 114 includes a rigid portion 174 and a biasing portion 176. Rigid portion 174 is coupled to housing bottom wall 132 and includes top end 134. Biasing portion 176 is coupled to lid 172. In the exemplary implementation, rigid portion 174 may be formed from at least two rigid sections. In such a configuration, the rigid sections are coupled together using a clamp 178 (shown in FIG. 5) such that no portion of a fastener extends through rigid portion 174 and into the channel through which the waste travels. Alternatively, adjacent rigid sections of rigid portion 174 are coupled together in any manner to enable operation of waste management system 100 as described herein. Furthermore, rigid portion 174 is formed from a metallic material, such as, but not limited to, aluminum, such that rigid portion 174 is a relatively lightweight, non-corrosive material. Biasing portion 176 is formed from a translucent or transparent, fire-resistant material that enables a technician to observe when container 120 is full or if biasing portion 176 contains waste. Alternatively, portions 174 and 176 are formed from any material that facilitates operation of chute 114 as described herein.

Figure 5:
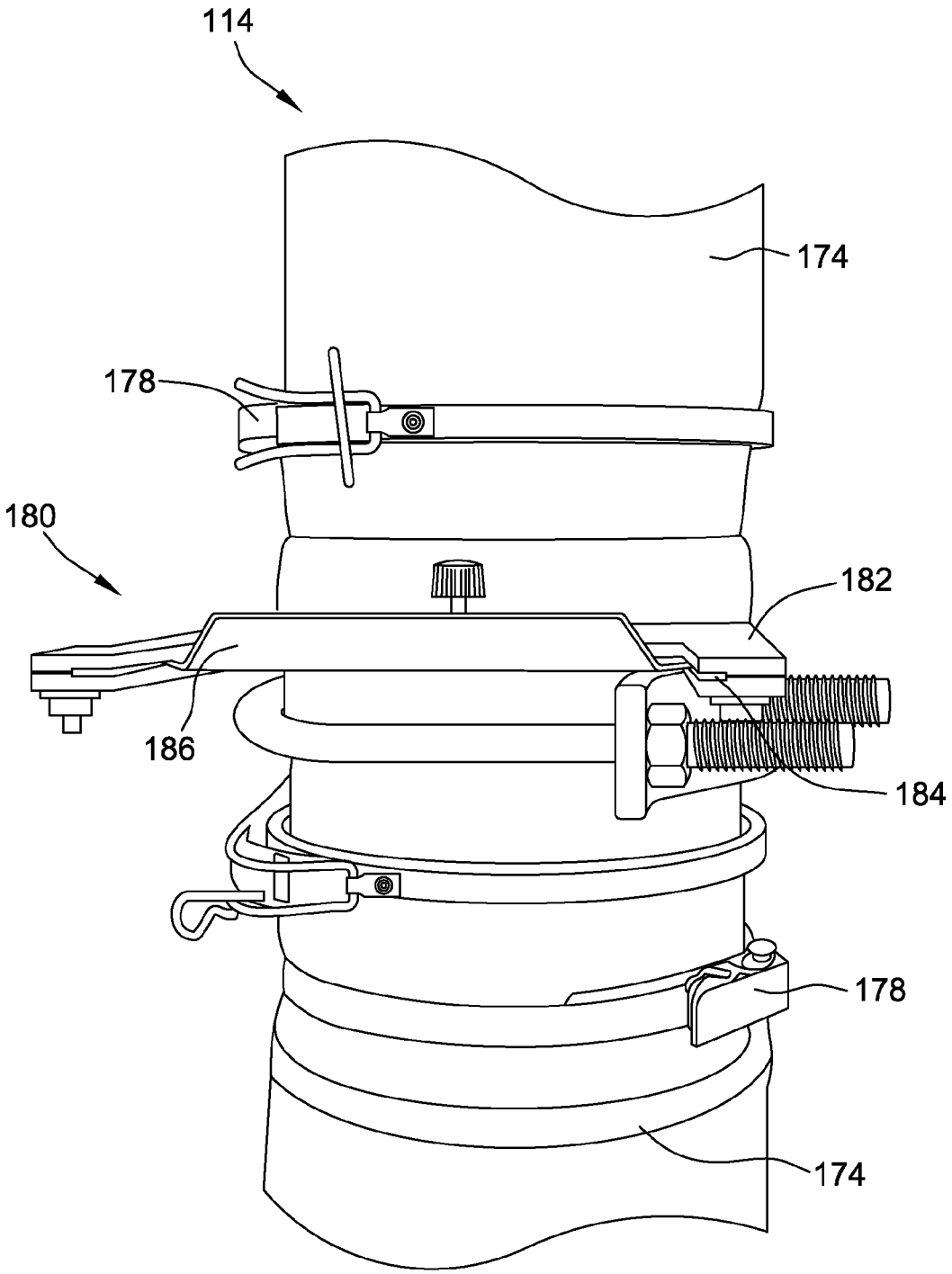
FIG. 5 is a side view of an exemplary chute gate assembly that may be used with the waste management system shown in FIG. 1.

In the exemplary implementation, chute 114 also includes a gate assembly 180 coupled between rigid portion 174 and biasing portion 176 of chute 114, as shown in FIG. 1. Alternatively, gate assembly 180 is coupled between adjacent rigid sections of rigid portion 174, as shown in FIG. 5. Gate assembly 180 includes a housing 182 coupled between adjacent portions of chute 114. Housing 182 defines a slot 184 that is configured to receive a gate 186 therein. Gate 186 is configured to selectively slide into and out of slot 184 to selectively block chute 114 when a technician is in the process of emptying container 120. As such, technicians working on platform 110 may continue to use waste disposal station 102 to deposit waste even during emptying of containers 104 at ground level 112. When container 120 is emptied and replaced, the technician slides gate 186 partially out of slot 184 to allow any waste deposited during emptying of container 120 to fall into container 120.

Figure 6:
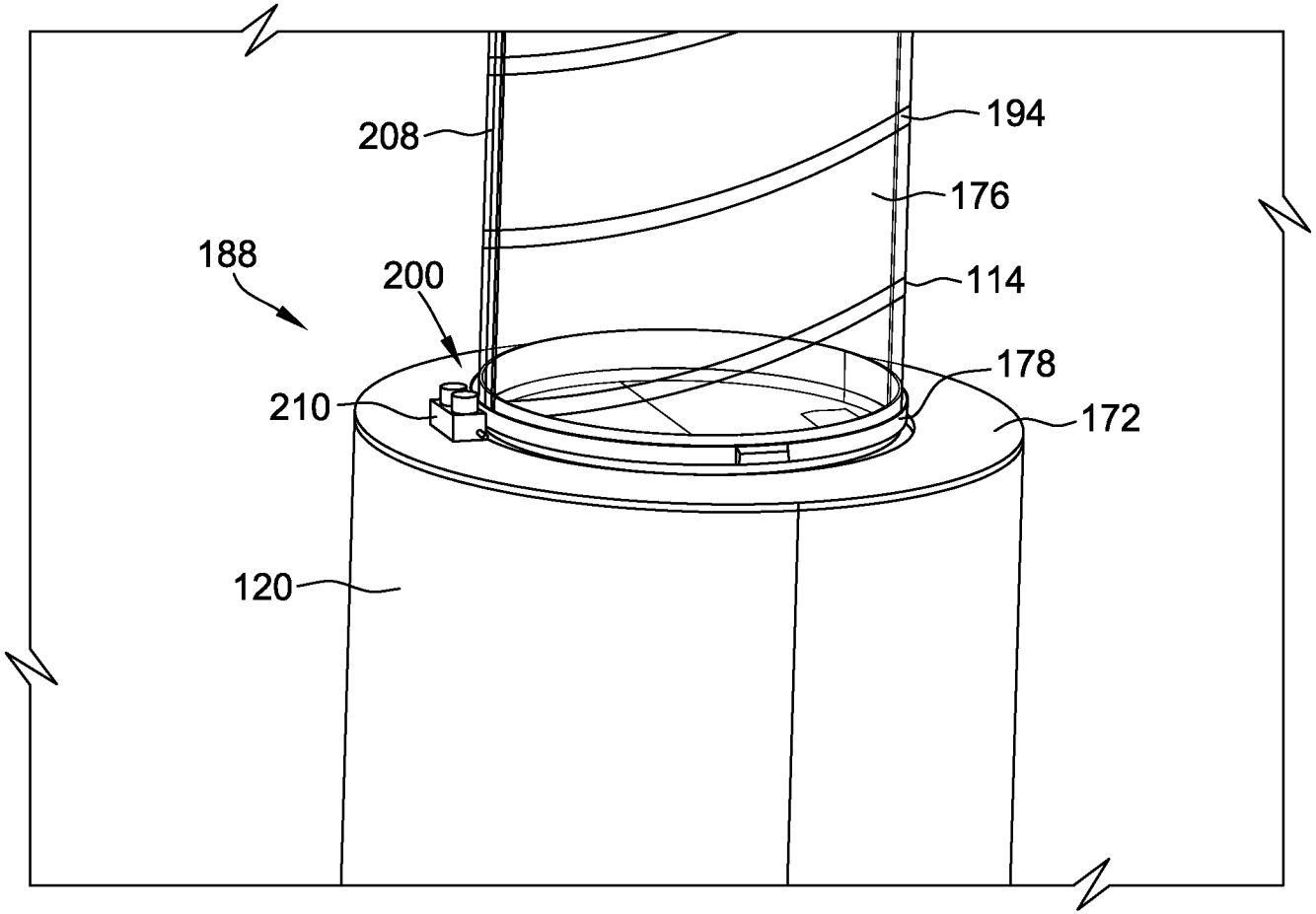
FIG. 6 is a perspective view of a chute and an associated container and container lid.

FIG. 6 is a perspective view of a containment lid assembly 188 including first chute 114, lid 172, and container 120. In the exemplary implementation, containment lid assembly 188, and more specifically vapor lock system 200, substantially contains any vapors and/or airborne particles within container 120 and prevents such vapor from traveling up chute 114. Containment lid assembly 188 includes biasing portion 176, a coupling 190, lid 172, and container 120. Coupling 190 is coupled to a bottom end of biasing portion 176 with a clamp 178 and to lid 172 with plurality of fasteners (not shown). Alternatively, coupling 190 is coupled to biasing portion 176 and lid 172 in any manner that facilitates operation of containment lid assembly 188 as described herein. Coupling 190 defines an opening 196 in lid 172 that enables waste to pass from chute 114, through opening 196, and into container 120.

In the exemplary implementation, biasing portion 176 includes a flexible coil 194 that enables biasing portion 176 to stretch and compress in length. In operation, when lid 172 is coupled to container 120 in a snap fit relationship, coil 194 is compressed from a resting length to a shorter compressed length such that coil 194 biases lid 172 downward onto container 120. As such, biasing portion 176 applies a positive pressure to lid 172 that maintains engagement between lid 172 and container 120. A technician may easily break the biased engagement and lift lid 172 from container 120 when container 120 is to be emptied. When lid 172 and container 120 are decoupled, lid 172 then remains coupled to biasing portion 176 as biasing portion 176 extends into its resting length until the technician again compresses coil 194 in biasing portion 176 to couple lid 172 to container 120.

Figure 7:
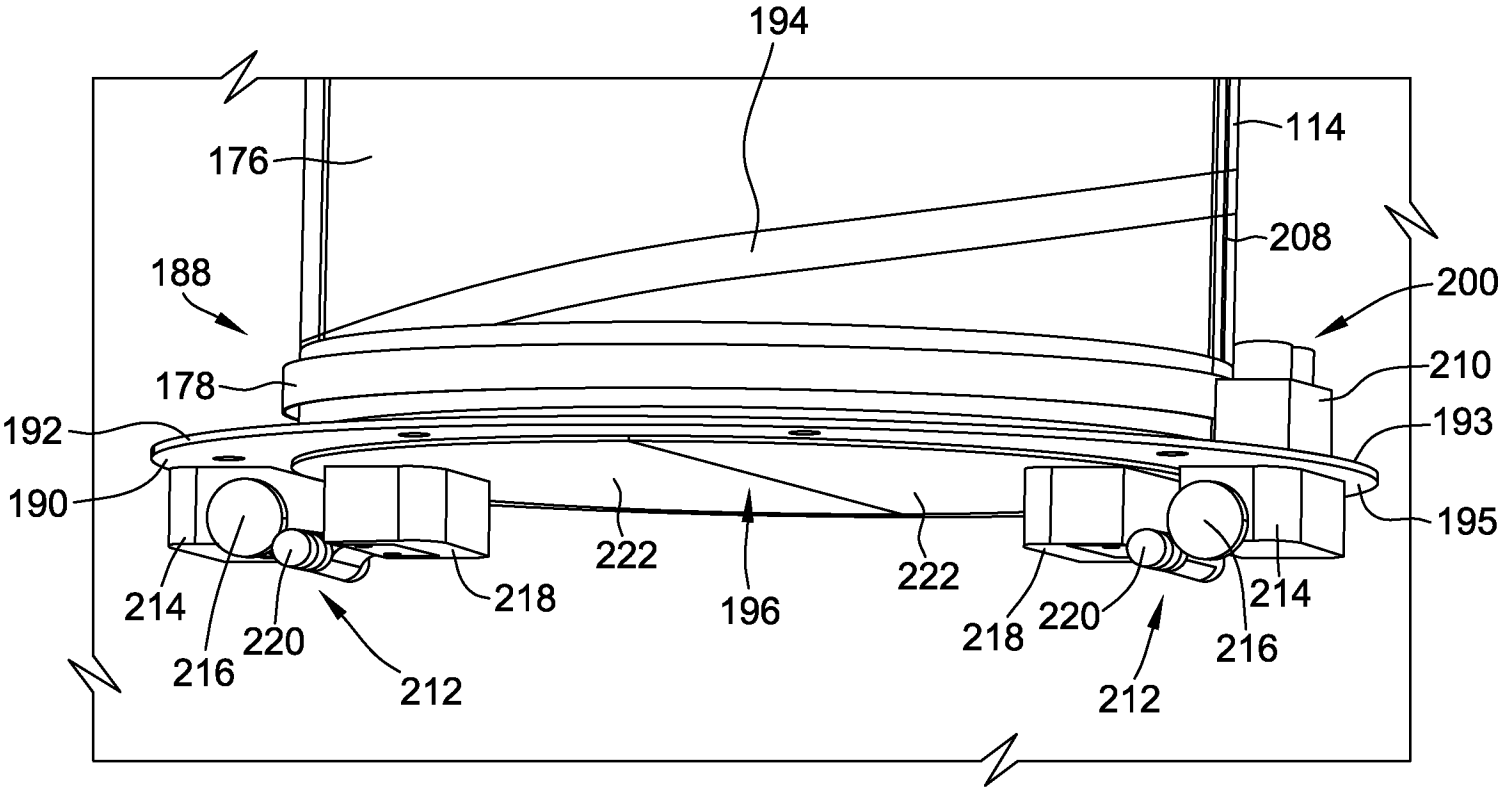
FIG. 7 is a perspective view of the chute and an exemplary electronic vapor lock system, which may be used with the waste management system shown in FIG. 1, with the container and container lid removed for clarity

FIG. 7 is a perspective view of an exemplary electronic vapor lock system 200 of containment lid assembly 188. Container 120 and lid 172 are removed from FIG. 7 for clarity. In the exemplary implementation, electronic vapor lock system 200 includes first sensor 202, a controller 210, and a pair of pivoting mechanisms 212. As described above, a first sensor 202 is coupled to top end 134 and signal line 208 extends from sensor 202 along chute 114 to controller 210. In the exemplary implementation, controller 210 is coupled to a flange 192 of coupling 190. More specifically, controller 210 is coupled to a top surface 193 of flange 192. As such, controller 210 and the electronics thereof, are positioned outside container 120 to reduce a risk of ignition of any vapors within container 120. In the exemplary implementation, vapor lock system 200 includes a single controller 210 that controls both pivoting mechanisms 212. Alternatively, vapor lock system 200 includes a pair of controllers 210 communicatively coupled to a respective one of pivoting mechanism 212. In such a configuration, each controller 210 is coupled to first sensor 202 with a respective signal line 208.

In the exemplary implementation, each pivoting mechanism 212 includes a motor housing 214, a first gear 216, a pivoting housing 218, and a second gear 220. Motor housing 214 is coupled to a bottom surface 195 of coupling flange 192 and houses a motor (not shown) communicatively coupled to and controlled by controller 210. The motor is coupled to first gear 216 and facilitates rotation of first gear 216 upon receipt of a signal from controller 210. Each pivoting housing 218 is coupled to a separate flap 222, which, in combination, substantially cover opening 196. Second gear 220 is coupled to pivoting housing 218 and is rotatably coupled to first gear 216 such that rotation of first gear 216 causes rotation of second gear 220 and pivoting housing 218. As such, controller 210 automatically controls the motors within housings 214 to rotate first gear 216 to cause rotation of second gear 220 and pivoting housing 218 such that the associated flap 222 is pivoted from a first, closed, position to a second, open, position.

In the exemplary implementation, at least one of motor housing 214, first gear 216, pivoting housing 218, and second gear 220 is fabricated from an electrically non-conductive material, such as, but not limited to, plastic or rubber to reduce a risk of sparking within container 120.

Alternatively, motor housing 214, first gear 216, pivoting housing 218, and second gear 220 are each fabricated from any material that enables vapor lock system 200 to operate as described herein.

In operation, a technician lifts lid 150 (shown in FIG. 3) to deposit waste into chute end 134 (shown in FIG. 2) at waste disposal station 102 (shown in FIG. 2). Lifting of lid 150 removes the biasing force from sensor pin 206 and causes pin 206 to extend from housing 204 and complete a circuit that transmits a signal to controller 210 through signal line 208. Controller 210 receives the signal and controls pivoting mechanisms 212 to pivot flaps 222 to allow the waste to fall through opening 196. More specifically, controller 210 activates the motor based on the signal from sensor 202 to rotate first gear 216 to cause rotation of second gear 220 and pivoting housing 218 such that the associated flap 222 is pivoted from a first, closed, position to a second, open, position. In the open position, flaps 222 allow the waste to fall through opening 196 into container 120. Flaps 222 are pivoted as quickly as possible to prevent the waste from impacting flaps 222 before they open. As long as lid 150 is open and sensor pin 206 is not biased downward, sensor 202 sends a continuous signal to controller 210 indicating that lid 150 is open and controller 210 controls pivoting mechanisms 212 to maintain flaps 222 in the open position.

Upon closure of lid 150, sensor 202 indicates as such by transmitting a signal to controller 210. Controller 210 receives the signal and executes a delay for a predetermined amount of time before controlling pivoting mechanisms 212 to pivot flaps to the second position to close opening 196. The delay between lid 150 closure and flap 222 pivoting ensures that all material has left chute 114 and has been deposited into container 120. This prevents material from becoming trapped on the top side of flaps 222. After the delay has expired, controller 210 causes flaps 222 return to the closed position to substantially prevent vapors or airborne particles in the waste from traveling up chute 114. As described above, each of chutes 116 and 118 includes a containment lid assembly and a vapor lock system similar to assembly 188 and system 200 as described with respect to chute 114. Alternatively, chutes 114, 116, and 118 have any combination of assembly 188 and system 200 that enables waste management system 100 to operate as described herein.

The embodiments described herein facilitate depositing various types of waste into a respective chute on a platform and collecting the waste in containers located at ground level. A technician determines whether they have FOD waste, corrosive waste, or flammable waste and deposits the waste into the appropriate chute at a waste disposal station on the platform. The waste then travels through the chute and into a corresponding container located at ground level. When the container is full, another technician slides the gate inward to block the chute and removes the lid from the container. The lid remains coupled to the biasing portion of the chute while the technician empties the container. Once the container is emptied, the technician at least partially compresses the biasing portion of the chute to lift the lid above the container and then couples the lid to the container. The coil within the biasing portion causes the lid to apply a downward force onto the container to maintain a tight engagement.

As described herein, the waste management system allows technicians to deposit waste into an appropriate chute from a working platform such that the waste collects in containers at ground level. Therefore, technicians responsible for emptying the container are no longer required to climb a set of stairs onto the platform to empty the containers. Storing the containers at ground level provides cost savings in that technicians do not have to climb stairs 75-100 times per day as with at least some known waste management systems. Furthermore, any potential safety risks from the technicians carrying containers or bags of waste down from the platform are mitigated. Additionally, storing the containers at ground level and providing an over-the-rail waste disposal station provides for additional work space on the platforms for the technicians to perform their duties without the risk of tripping on one of the containers.

Furthermore, the embodiments described herein illustrate a vapor lock system that enables automated opening and closing of flaps on the container at the bottom of the chute. The vapor lock system includes a sensor positioned at the chute lid to determine the position (open or closed) of the chute lid. The sensor transmits the position signal to a controller that operates a pair of pivoting mechanisms based on the position signal from the sensor. Each pivoting mechanism includes a pair of wheel gears that are driven by a motor controlled by the controller. The wheel gears rotate to pivot an associated flap between the open and closed positions to selectively enable waste to be deposited into the container. The wheel gears are driven by a motor to open and close an associated flap, rather than using springs or biasing mechanisms that may wear out. As described above, the controller is positioned outside the chute and container and the components of each pivoting mechanism positioned inside the container are either housed in or formed from a non-conductive material to prevent sparks, ignition, and contamination Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A waste containment system for use with a waste management system having a chute and a container, said waste containment system comprising:

a sensor configured to determine a position of a chute top lid;

at least one pivoting mechanism operatively coupled to at least one flap of a container top lid, said at least one pivoting mechanism configured to move said at least one flap between an open position and a closed position; and a controller operatively coupled to said sensor and to said at least one pivoting mechanism, said controller configured to control said at least one pivoting mechanism based on the determined position of the chute top lid to open said at least one flap when said chute top lid is open.

2. The waste containment system in accordance with claim 1, wherein said sensor is positioned proximate the chute top lid.

3. The waste containment system in accordance with claim 1, wherein said controller is coupled to said container top lid such that said controller is positioned outside the chute and the container.

4. The waste containment system in accordance with claim 1, wherein said at least one pivoting mechanism comprises:

a stationary housing coupled to said container top lid, said stationary housing configured to house a motor;

a first gear coupled to the motor;

a pivoting housing coupled to the at least one flap; and a second gear coupled to said pivoting housing and to said first gear such that rotation of said first gear facilitates movement of said at least one flap.

5. The waste containment system in accordance with claim 1, wherein at least a portion of said pivoting mechanism exposed to waste in the container is fabricated from an electrically non-conductive material.

6. The waste containment system in accordance with claim 1, wherein said sensor is one of a biased pin sensor and an optical sensor.

7. The waste containment system in accordance with claim 1, wherein said container top lid includes a pair of flaps each having an associated pivoting mechanism operatively coupled to said controller.

8. The waste containment system in accordance with claim 1, wherein said controller is configured to close said at least one flap when said chute top lid is closed.

9. The waste containment system in accordance with claim 1, wherein closing of said at least one flap is delayed for a predetermined period of time after said chute top lid is closed.

10. A waste management system comprising:

a chute comprising a bottom end, a top end, and a chute lid coupled at said top end;

a container comprising a container lid coupled to said bottom end, said container lid comprising an opening defined therein and at least one flap configured to selectively cover at least a portion of the opening; and a waste containment system comprising:

a sensor configured to determine a position of said chute lid;

at least one pivoting mechanism operatively coupled to said at least one flap, said at least one pivoting mechanism configured to move said at least one flap between an open position and a closed position; and a controller operatively coupled to said sensor and to said at least one pivoting mechanism, said controller configured to control said at least one pivoting mechanism based on the determined position of the chute lid to open said at least one flap when said chute top lid is open.

11. The waste management system in accordance with claim 10, wherein said controller is coupled to said container top lid such that said controller is positioned outside the chute and the container.

12. The waste management system in accordance with claim 10, wherein said at least one pivoting mechanism comprises:

a stationary housing coupled to said container top lid within said container, said stationary housing configured to house a motor;

a first gear coupled to the motor;

a pivoting housing coupled to the at least one flap within said container; and a second gear coupled to said pivoting housing and to said first gear such that rotation of said first gear facilitates movement of said at least one flap.

13. The waste management system in accordance with claim 12, wherein at least said first gear and said second gear exposed to waste in said container are fabricated from an electrically non-conductive material.

14. The waste management system in accordance with claim 10, wherein said container top lid includes a pair of flaps each having an associated pivoting mechanism operatively coupled to said controller.

15. The waste management system in accordance with claim 10, wherein said controller is configured to close said at least one flap when said chute top lid is closed.

16. The waste management system in accordance with claim 10, wherein closing of said at least one flap is delayed for a predetermined period of time after said chute top lid is closed.

17. A method of assembling a waste containment system for use with a waste management system having a chute and a container, said method comprising:

coupling a sensor to a chute top end proximate a chute top lid, wherein the sensor is configured to determine a position of the chute top lid;

coupling at least one pivoting mechanism to a flap of a container top lid, wherein the at least one pivoting mechanism is configured to move the flap between an open position and a closed position; and coupling a controller to the container top lid, wherein the controller is operatively coupled to the sensor and to the at least one pivoting mechanism such that the controller moves the at least one pivoting mechanism based on the determined position of the chute top lid to open the flap when the chute top lid is open.

18. The method according to claim 17, wherein coupling a controller to the container top lid comprises coupling the controller to a top surface of the container top lid such that the controller is positioned outside the container.

19. The method according to claim 17, wherein coupling at least one pivoting mechanism to a flap of a container top lid comprises coupling a pivoting mechanism to each flap of a pair of flaps that selectively obstruct an opening in the container top lid.

20. The method according to claim 17, wherein coupling at least one pivoting mechanism to a flap of a container top lid comprises:

coupling a stationary housing to a bottom surface of the container top lid, wherein the stationary housing houses a motor;

coupling a first gear to the motor;

coupling a pivoting housing to the flap; and coupling second gear to the pivoting housing and to the first gear such that rotation of the first gear facilitates movement of the flap.

* * * * *